US006260940B1

(12) United States Patent
Yamada et al.

(10) Patent No.: US 6,260,940 B1
(45) Date of Patent: Jul. 17, 2001

(54) INK JET PRINTING SYSTEM HAVING INK PREHEATING DURING NON-PRINTING PERIODS

(75) Inventors: Akitoshi Yamada; Hiromitsu Hirabayashi; Akihiko Sukigara, all of Irvine, CA (US)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/070,919

(22) Filed: May 4, 1998

(51) Int. Cl.[7] ..... B41J 29/38
(52) U.S. Cl. ..... 347/17
(58) Field of Search ..... 347/17, 14, 23, 347/15, 60, 76, 11, 6, 49, 19, 26; 400/120

(56) References Cited

U.S. PATENT DOCUMENTS

| | | | | |
|---|---|---|---|---|
| 4,449,137 | | 5/1984 | Inui et al. | 346/76 |
| 4,788,563 | * | 11/1988 | Omo et al. | 347/14 |
| 5,172,130 | * | 12/1992 | Takahashi | 347/14 |
| 5,191,357 | | 3/1993 | Ono | 346/76 |
| 5,302,971 | * | 4/1994 | Ohba et al. | 347/17 |
| 5,502,469 | * | 3/1996 | Watanabe | 347/14 |
| 5,606,355 | * | 2/1997 | Komatsu | 347/14 |

FOREIGN PATENT DOCUMENTS

| | | | | |
|---|---|---|---|---|
| 0670219 | | 9/1995 | (EP) . | |
| 2208829 | | 4/1989 | (GB) . | |
| 58-116175 | | 7/1983 | (JP) . | |
| 58-197070 | | 11/1983 | (JP) . | |
| 62-173267 | | 7/1987 | (JP) . | |
| 4-085045 | | 3/1992 | (JP) . | |
| 5 169 644 | * | 7/1993 | (JP) | 347/17 |

* cited by examiner

*Primary Examiner*—John Barlow
*Assistant Examiner*—Charles W. Stewart, Jr.
(74) *Attorney, Agent, or Firm*—Fitzpatrick, Cella, Harper & Scinto

(57) ABSTRACT

An ink jet printing system having a preheating system for preheating ink during non-printing periods. The system receives print data and commands, feeds paper into the ink jet printer in response to the receipt of print data and commands, detects an ambient temperature within the ink jet printer and determines if the ambient temperature is above a predetermined threshold temperature, preheats the ink supplied to a print head in the ink jet printer during feeding of paper in the case the detected ambient temperature is below the predetermined threshold temperature, moves a printer carriage carrying the print head from a non-printing area to a printing area so as to print the print data. During the moving of the carriage from a non-printing area to a printing area, the ambient temperature is again detected and it is determined again if it is below the predetermined threshold temperature and, in the case that it is, the ink supplied to the print head is preheated during the moving of the printer carriage in the non-printing area.

39 Claims, 7 Drawing Sheets

INK JET PRINTING SYSTEM HAVING INK PREHEATING DURING NON-PRINTING PERIODS

BACKGROUND OF THE INVENTION

1. Field of the Invention

The present invention relates to ink jet printing systems and, more particularly, to an ink jet system having a preheating system which preheats ink during non-printing periods so as to prevent image density unevenness and to reduce the amount of energy to eject ink during printing periods.

2. Description of the Related Art

Ink jet printing systems have recently become very popular since they are both inexpensive and achieve high-quality color image printing. Conventionally, ink jet printers include interchangeable ink cartridges, integrating an ink tank for storing ink/dye and at least one print head for converting an electrical signal received from an external source, such as a personal computer, via the printer, into thermal energy-thereby discharging an ink droplet.

In such ink jet printers which employ print heads which utilize thermal energy for ink discharge, a known requirement for attaining high image quality is to control the temperature of both the print head and ink/dye which is discharged from the print head. This is because, if the temperature of the ink varies, the amount of ink discharged will vary depending on the temperature of both the print head and ink. As a result, unevenness in image density will appear in the printed image.

Conventionally, there are two methods of heating ink in order to eject ink in an ink jet printing system. The first method ejects ink droplets by performing thin-film boiling of the ink using heating elements at each print head nozzle. In this method of ejecting ink, the ink, which is either at room temperature or the environmental temperature within the printer, is moved from the ink tank directly to the nozzles of the print head where heat is applied in order to eject an ink droplet.

The second method ejects ink by raising the temperature of the ink from room or environmental temperature to a predetermined temperature while it is travelling to the print head and then performing thin film boiling of ink at each nozzle. In the second method, because the ink must be preheated first to the predetermined temperature, there is a short delay before printing can begin.

While both methods of heating ink to eject ink droplets are still used, the first method tends to produce droplets of varying sizes due to heat variations caused by non-uniformed heating of cool ink as it enters each nozzle. As a result, image density unevenness may occur. On the other hand, while the second method decreases non-uniformed heating of ink, due to preheating ink before it reaches each nozzle, the second method suffers from time delays which are required to preheat ink before printing.

Further attempts to those mentioned above have been made to reduce temperature dependent unevenness in image density and printing delays by measuring the temperature of the print head by using a temperature sensor or by estimating the temperature of the print head through record data and lookup tables. Other attempts have been made to control both the temperature of the print head and the ink by providing the print head with a heat generating member for heating the ink as it enters the print head. For example, by using a feed-back temperature control system by providing a temperature sensor in the print head.

In addition to the temperature sensor provided on the recording head, there may also be employed a highly precise temperature sensor, such as a thermistor, provided on the control circuit board in the main body of the printer. Such a configuration is used to detect the ambient temperature in the printer and to estimate the temperature of the print head and the ink in the ink tank by calculating from the variation in ambient temperature, the energy released through ink discharge and the energy dissipated to the external atmosphere.

However, even using the above temperature detection feed back, image density unevenness and time delays still occur because the ink/dye cannot be heated to the appropriate level before discharge. For example, if the ink/dye is not heated to the appropriate level at the expected time of discharge, the print head may misfire or the size of the ink droplet to be discharged, which is directly influenced by the amount of heat applied to the ink, may not be large enough for the appropriate image density thereby creating image density unevenness. As a result, image quality is affected as the ink and the print head heat up or down. Therefore, it is desirable to be able to provide an ink jet system which is capable of high quality image printing by controlling the heat of ink before the ink reaches the nozzles of the print head. Moreover, if the ink is maintained at a predetermined temperature prior to ejection, the amount of energy used to heat each nozzle heating element in the print head can be reduced.

SUMMARY OF THE INVENTION

It is the object of the invention to provide an ink jet printing system which preheats ink during non-printing periods so as to overcome disadvantages on the prior art system.

According to one aspect of the present invention, the invention is an ink ejecting apparatus for an ink jet printer which includes detecting means for detecting a temperature within the ink jet printer, determining means for determining if the detected temperature is below a predetermined threshold temperature, and preheating means for preheating ink supplied to a print head within the ink jet printer during non-printing periods. In the case it is determined that the detected temperature is below the predetermined threshold temperature, the ink supplied to the print head is preheated, and in the case it is determined that the detected temperature is above the predetermined threshold temperature, the ink supplied to the print head is not preheated.

According to another aspect of the present invention, the invention is an apparatus for preheating ink in an ink jet printer which includes receiving means for receiving print data and commands, feeding means for feeding paper into the ink jet printer in response to the receipt of print data and commands, detecting means for detecting an ambient temperature within the ink jet printer and determining if the ambient temperature is above a predetermined threshold temperature, preheating means for preheating the ink supplied to a print head in the ink jet printer during feeding of paper by the feeding means in the case the detected ambient temperature is below the predetermined threshold temperature, moving means for moving a printer carriage carrying the print head from a non-printing area to a printing area. During the moving of the carriage from a non-printing area to a printing area, the detecting means detects the ambient temperature again and determines if it is below the predetermined threshold temperature and, in the case that it is, the preheating means preheats the ink supplied to the print head during the moving of the printer carriage in the non-printing area.

A more complete understanding of the invention can be obtained by reference to the following detailed description of the preferred embodiment thereof in connection to the attached drawings.

DETAILED DESCRIPTION OF THE PREFERRED EMBODIMENTS

Figure 1:
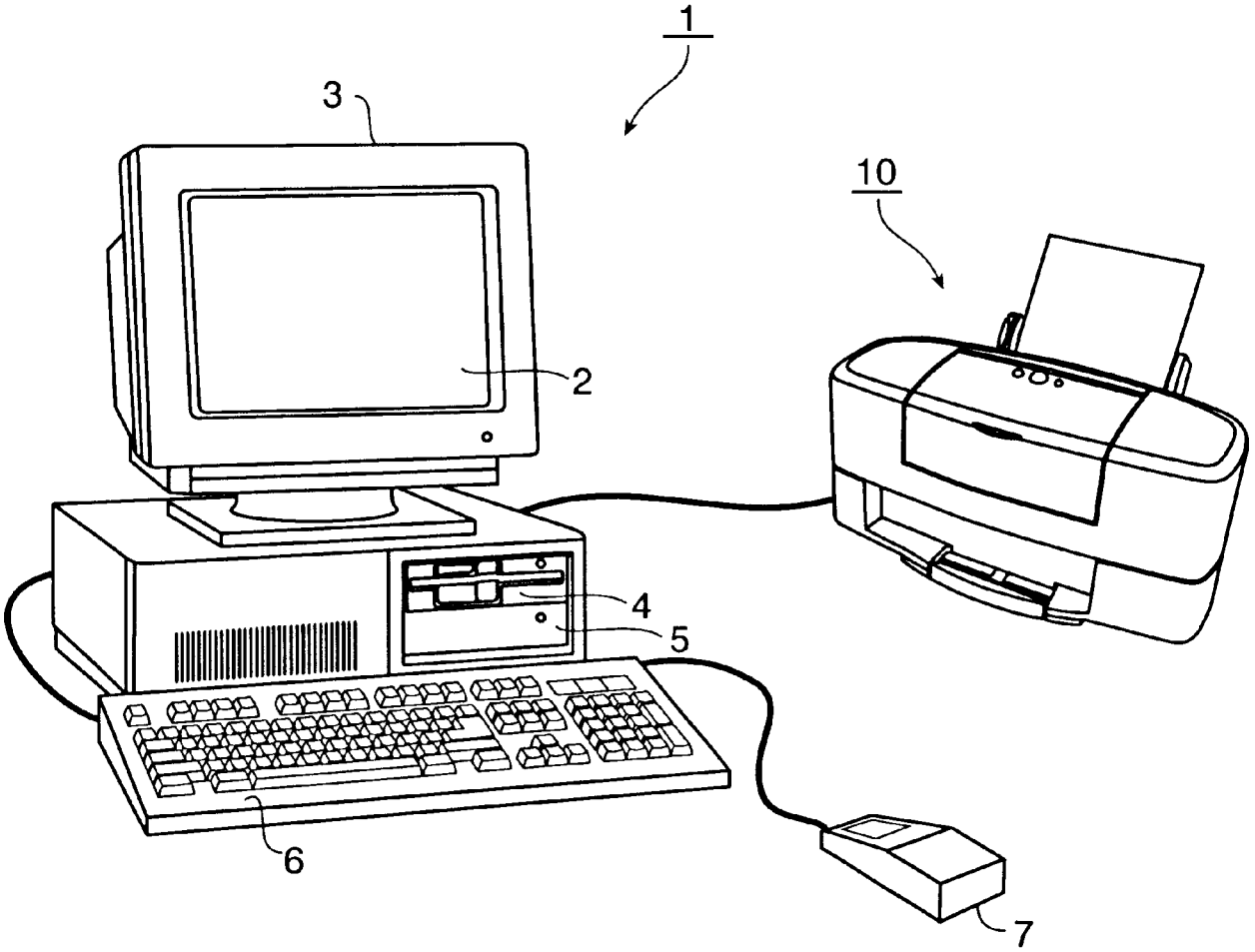
FIG. 1 is a view showing the outward appearance of computing equipment used in connection with the present invention.

FIG. 1 is a view showing the outward appearance of computing equipment used in connection with the invention described herein. Computing equipment 1 includes host processor 3. Host processor 3 comprises a personal computer, preferably an IBM PC compatible computer having a windowing environment, such as Microsoft® Windows 95. Provided with computing equipment 1 is display screen 2, comprising a color monitor or the like, keyboard 6 for entering text data and user commands, and pointing device 7. Pointing device 7 preferably comprises a mouse for pointing and for manipulating objects displayed on display screen 2.

Computing equipment 1 includes computer readable memory medium such as fixed computer disk 5 and floppy disk interface 4. Floppy disk interface 4 provides a means whereby computing equipment 1 can access information, such as data, application programs, etc., stored on floppy disks.

Disk 5 stores, among other things, application programs for which host processor 3 generates files, and manipulates and stores those files on disk 5, presents data in those files to an operator via display screen 2, and prints data in those files via printer 10.

Device drivers are also stored in disk 5. At least one of the device drivers comprises a printer driver which provides a software interface to firmware in printer 10.

Figure 2:
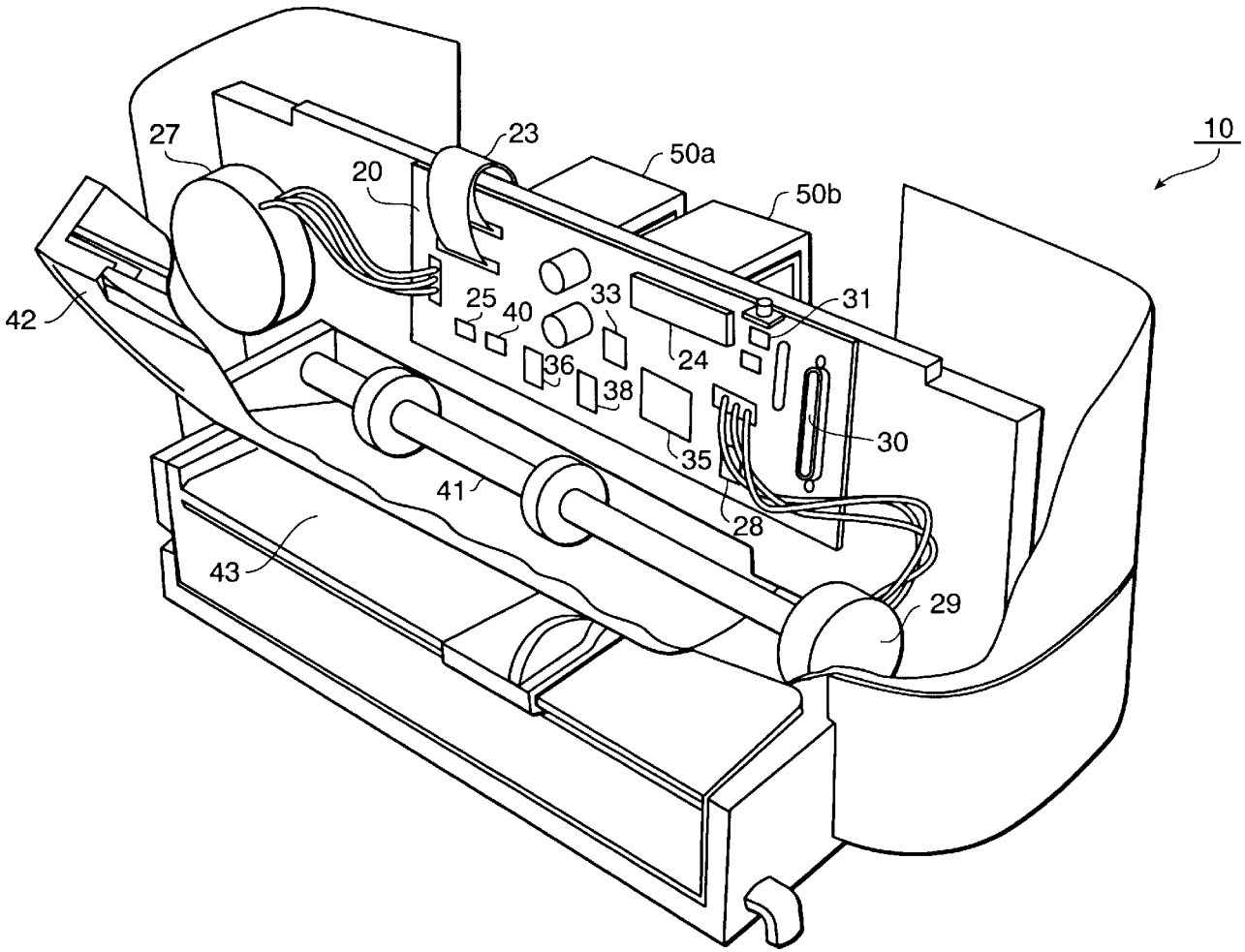
FIG. 2 is a back cut-away perspective view of the printer according to the present invention.
Figure 3:
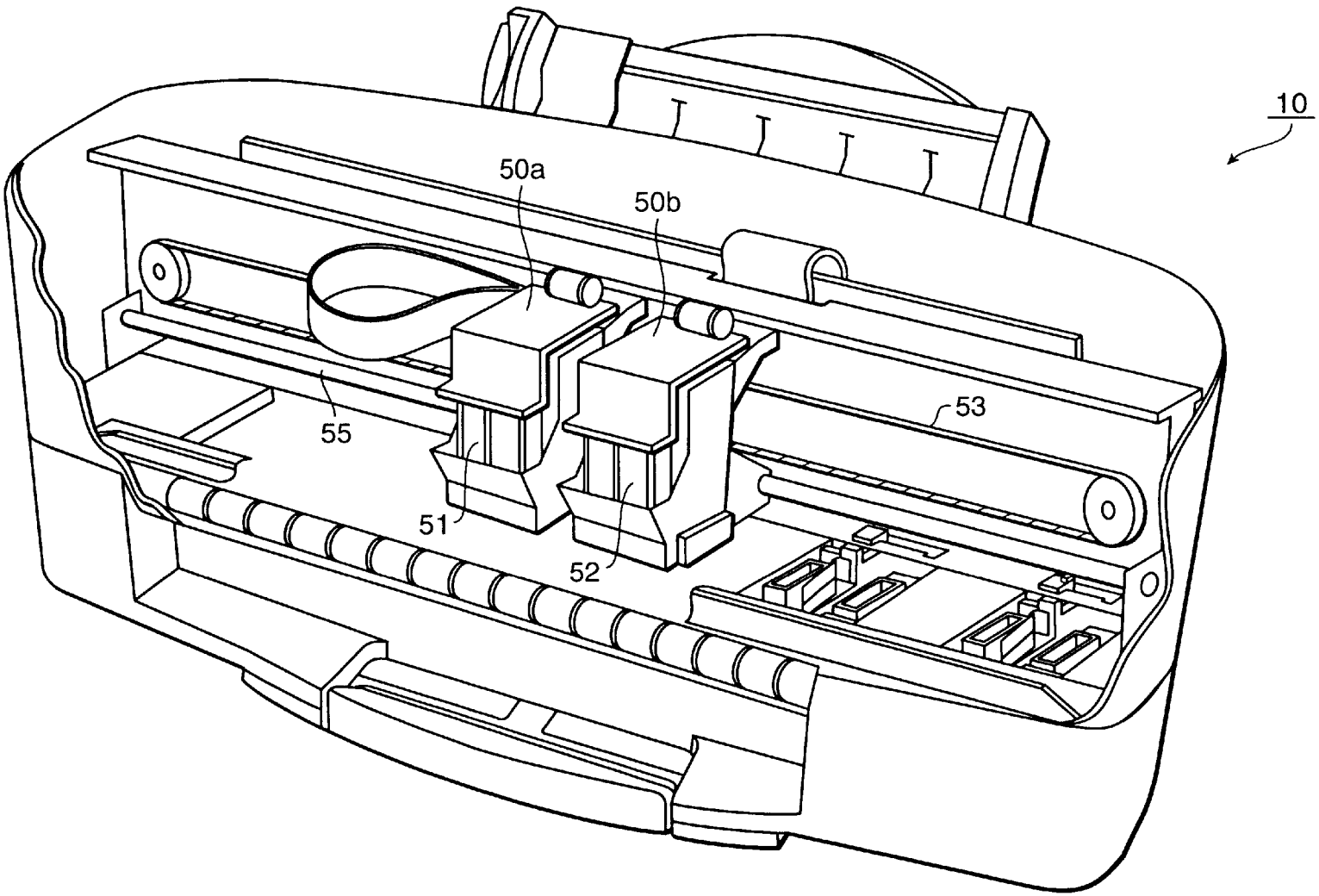
FIG. 3 is a front cut-away perspective view of the printer according to the present invention.

In the preferred embodiment of the invention, printer 10, is a multi-head ink jet printer with bi-directional printing capabilities. In this regard, FIGS. 2 and 3 show back and front cut-away perspective views, respectively, of printer 10. Control circuit board 20, shown in FIG. 2, is powered by a power supply unit (not shown). As shown in FIG. 2, circuit board 20 is connected to print head 50*a* and 50*b* by way of a flexible cable 23. On circuit board 20, there are provided a head driver IC 24 for controlling the ink discharge of print heads 50*a* and 50*b*, carriage motor driver IC for driving carriage motor 27, line feed motor driver IC 28 for driving line feed motor 29 and interface 30, DRAM 31, ROM 33, CPU 35, gate array 36, and control panel unit 38 for keys and LEDs. Also provided on board 20, in addition to various capacitors and resistors, is thermistor 40 for detecting the ambient temperature within printer 10.

Printer 10 also includes rollers 41 for transporting media from either automatic feeder 42 or manual feeder 43 through printer 10 to a media eject port. Line feed motor 29 controls the rotation of roller 44. Line feed motor 29 comprises a 96-step, 2—2 phase pulse motor and is controlled in response to commands received from line feed motor driver IC 28.

As shown in FIG. 3, printer 10 is a dual cartridge printer which prints images using two disposable print heads 50*a* and 50*b* (i.e., one head per cartridge). Specifically, these cartridges are held side by side in cartridge receptacles 51 and 52, such that respective print heads on the cartridges are offset horizontally from each other. Carriage motor 27, shown in FIG. 2, controls the bi-directional movement of cartridge receptacles 51 and 52 in response to commands received from circuit board 20. Specifically, carriage motor 27 controls the motion of belt 53 which in turn controls the bi-directional movement of cartridge receptacles 51 and 52 along carriage 55. In this regard, carriage motor 27 provides for bi-directional motion of belt 53 and thus of cartridge receptacles 51 and 52. By virtue of this feature, printer 10 is able to print images quickly and efficiently using both left to right and right to left printing.

Carriage motor 27 comprises a 96-step, 2-2 phase pulse motor having a carriage resolution of 9/360 inches/pulse. Carriage motor 27 is driven by a motor driver having a four level control. When printer 10 is printing in a 360 dpi mode, carriage motor 27 is driven to cause cartridge receptacles 51 and 52 to move along carriage 55 at a default speed of 459.32 mm/sec. In contrast, when printer 30 is printing in the 720 dpi mode, carriage motor 27 is driven to cause cartridge receptacles 51 and 52 to move along carriage 55 at a default speed of 229.66 mm/sec. In both printing speeds, print head cartridges 51 and 52 are driven from a standing start to a speed above the target default speed before entering the printing area. Upon entering the printing area, carriage motor 27 causes the cartridge receptacles 51 and 52 to move along carriage 55 at the desired default speed. Once an entire scan line has been printed, the speed of carriage motor 27 is ramped down or reduced in preparation of printing the next scan line in the opposite direction in the case of bi-directional printing or the carriage is reversed to begin printing again from the right side of the printing area.

Figure 4:
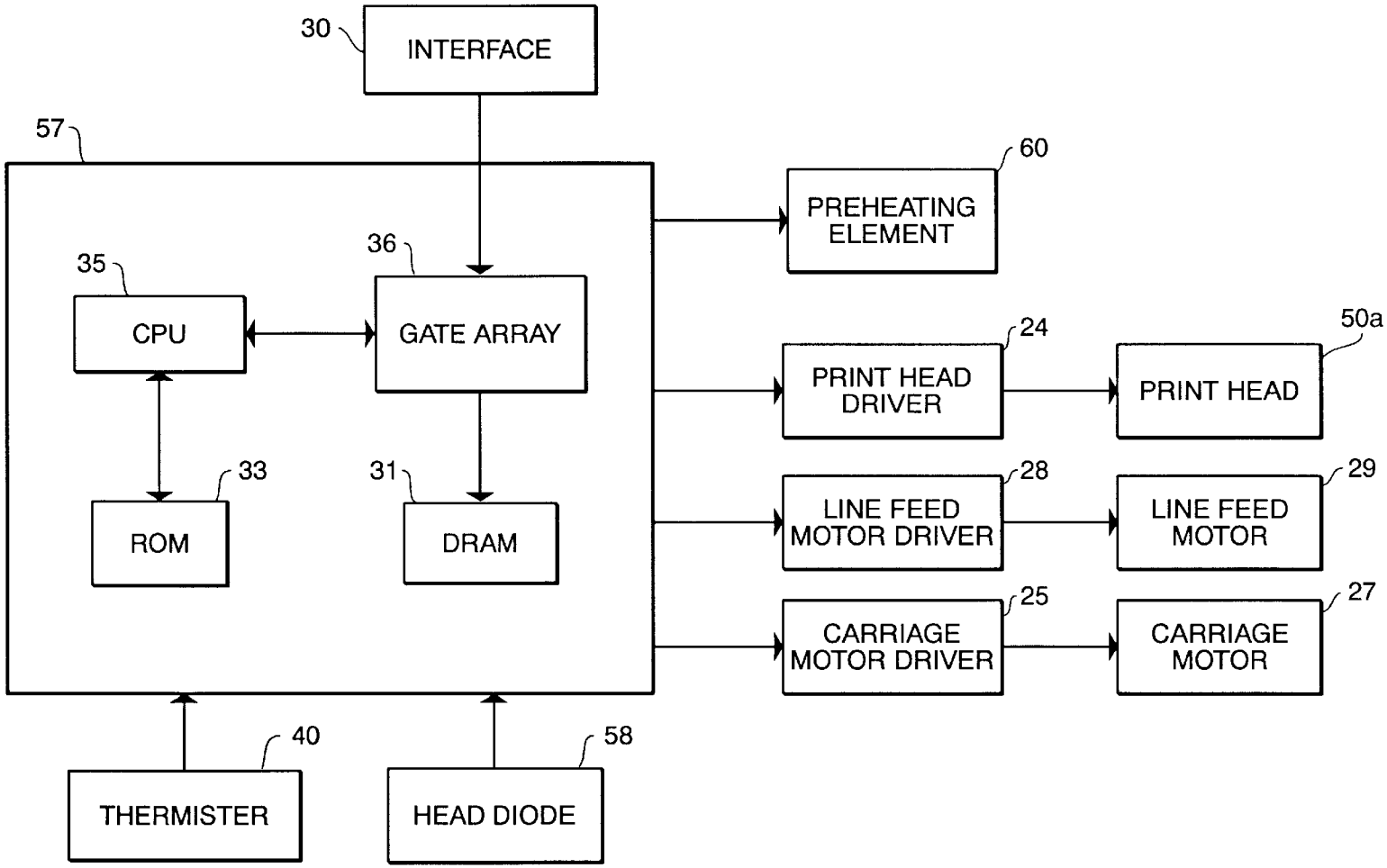
FIG. 4 is a block diagram illustrating the control system of the printer of the present invention.

FIG. 4 is a block diagram illustrating the control system of printer 10. As shown in FIG. 4, control system 57 includes interface 30 which provides the interface between printer and host computer 1. Interface 30 provides the signal path for receiving print data and commands from host computer 3. ROM 33 stores control programs to be executed by CPU 35 and DRAM 31 stores various data while CPU 35 is executing programs stored in ROM 33 as well as storing data to be supplied to print heads 50*a* and 50*b* for printing.

Gate array 36 controls the supply of print data from RAM 31 to print heads 50*a* and 50*b* and also controls the data transfer between interface 30, CPU 35 and RAM 31.

In response to signals output from control system 57, carriage motor 27 moves print heads 50*a* and 50*b* to a print position on a scan line. Likewise, in response to signals from CPU 35 and print head driver 24 and line feed motor driver 28, print head drivers 50*a* and 50*b* and paper advance of the recording sheet are controlled, respectively.

In the above explained control system 57, a recording signal enters into printer 10 from interface 30 and is converted into print data by gate array 36 and CPU 35. Then, in synchronization with the activation of motor drivers 24, 25 and 28, printing heads 50*a* and 50*b* are driven according to the print data supplied to print head driver 24 thereby affecting printing.

Also shown in FIG. 4 is thermistor 40 and head diode 58. According to the present invention, ink jet printing is affected by print heads 50*a* and 50*b* by means of electrothermal converting elements for generating thermal energy for inducing film blowing in the ink based on an electrical signal provided by head driver 24. Because the temperature of the print head controls ink ejection, it is very important, as explained previously, that this temperature is known. Therefore, outputs of thermistor 40, which measures the ambient temperature within the printer and outputs from head diode 58 for each print head 50*a* and 50*b* are closely monitored. The temperature of each print head is also calculated using known techniques, for example, the calculated head temperature technique disclosed in U.S. patent application Ser. No. 08/972,307.

According to the present invention, to ensure proper print quality and density, the present invention preheats the ink to a predetermined temperature, which in the preferred embodiment of the invention is between 35° C.–40° C., in order to reduce the time it takes to begin a print job (due to the time it takes to heat ink at the print head nozzle) and to ensure proper ink drop size which is directly related to the amount of heat at the print head nozzle, i.e., more heat applied to the ink the larger the drop that is ejected. In addition, because each nozzle heating element must be energized quickly on and off in order to eject individual ink droplets, the amount of time and energy needed to heat each nozzle heating element to produce an ejected ink droplet will be reduced if the ink is sufficiently heated to nearly its boiling point prior to it reaching each nozzle. Therefore, CPU 35 controls the amount of energy supplied to preheating elements 60 in order to preheat the ink during non-printing periods. CPU 35 only executes the preheating operation if the ambient temperature is below a predetermined threshold temperature which according to the present invention is 50° C. If the ambient temperature is above the predetermined threshold temperature, preheating will not be required.

Thus, in the present invention, CPU 35 controls preheating elements 60 which preheat the ink supply 61 supplied to print heads 50*a* and 50*b*. In addition, CPU 35 controls each nozzle heating element 64 for each print head 50*a* and 50*b* based on both calculated head temperature and the output temperature from head diode 58. The control of the preheating element for preheating ink will be discussed in greater detail below.

Figure 5:
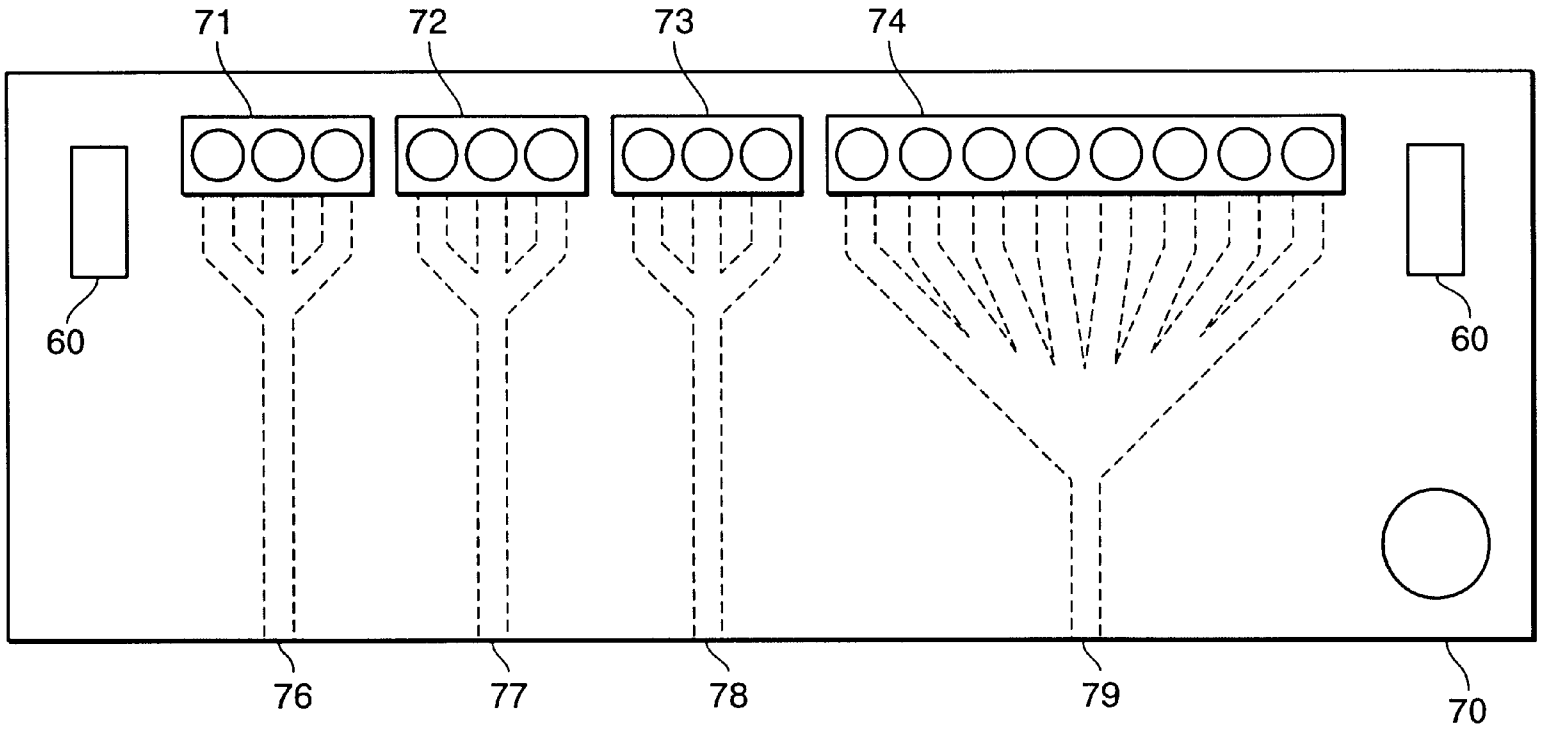
FIG. 5 is a schematic block diagram depicting the concept of the heater board used in the printer of the present invention.

FIG. 5 is a block diagram depicting the concept of heater board 70 made in the form of a silicon wafer chip and used in each print head 50*a* and 50*b*. Heater board 70 is identical in each print head, therefore only one will be discussed here for the sake of brevity.

Constructed on heater board 70 are heating elements 71, 72, 73 and 74 which are placed beneath the flow of ink directly behind each ejection nozzle for ejecting cyan, magenta, yellow and black inks, respectively. Heater board 70 has a yellow nozzle group a magenta nozzle group, a cyan nozzle group and a black nozzle group. In a typical print head, yellow, magenta, and cyan nozzle groups, each have 24 nozzles; black nozzle group 75 has 64 nozzles. In FIG. 5, far fewer nozzles (represented by the small circles) are shown for the sake of clarity. It should be noted that the invention is equally applicable to print heads that have a different number and type of nozzles, such as a print head that has 128 black nozzles and no color nozzles. Although each heating element is depicted as a unitary heating element, heating elements 71, 72, 73 and 74 are in reality individual heating elements for each print head nozzle.

In addition to heating elements 71, 72, 73 and 74, heater board 70 includes preheating elements 60 which preheat the ink which is supplied to heating elements 71, 72, 73 and 74. Preheating elements 60 raise the temperature of the ink prior to reaching each nozzle thereby reducing the amount of energy required to heat the ink to its boiling temperature which is performed by heating elements 71, 72, 73 and 74. That is, preheating elements 60 are used for heating ink as it passes through heater board 70 to a predetermined temperature. Each preheating element 60 is positioned at opposite lateral ends and outside the range of heater elements 71, 72, 73 and 74. Also included on heater board 70 is head temperature diode 58 which provides an output temperature of its respective print head to CPU 35.

As will be discussed below in greater detail, during non-printing periods such as paper feeding and movement of the carriage, outside the printing area of printer 10, preheating elements 60 preheat the ink to a predetermined temperature as it makes its way to heating elements 71, 72, 73 and 74. In this manner, not only less energy will be required to eject ink droplets from each print head nozzle, but also misfiring of nozzles in each print head can be prevented while ejecting ink droplets of proper size.

Liquid passageways 76, 77, 78 and 79 connect its respective ink tank (not shown) to each heating element 71, 72, 73 and 74, on heater board 70. Each liquid passageway 76, 77, 78 and 79 are further separated or divided into channels so that different inks are not mixed together and so that each particular ink is separately channeled to separate nozzles in each print head section for cyan, magenta, yellow and black. If necessary, as the ink makes its way from its respective ink tank through each liquid passageway 76, 77, 78 and 79 on heater board 70, preheating elements 60 will preheat the ink in each liquid passageway prior to its arrival at each heating element 71, 72, 73 and 74.

Figure 6A:
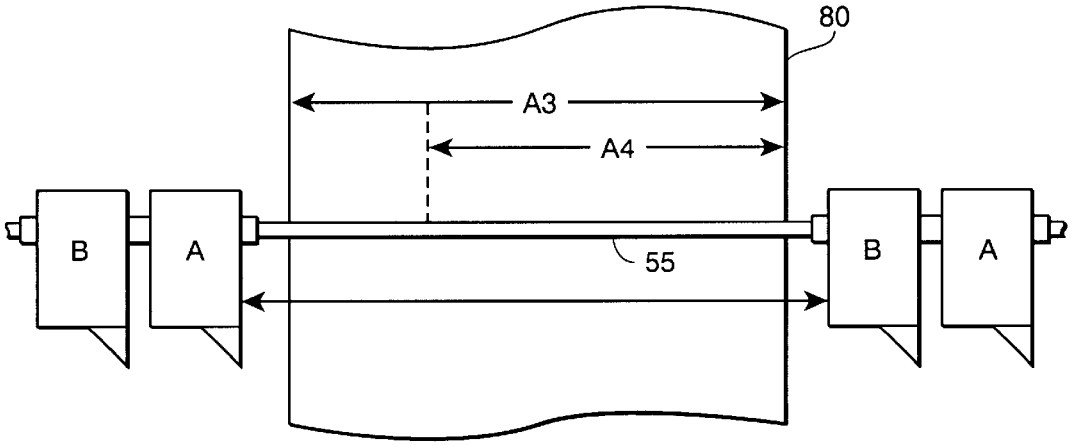
FIG. 6A is an illustrative diagram showing the printing and non-printing area of the printer according to the present invention.

According to the present invention, print heads 50*a* and 50*b* print in a bi-directional fashion. That is, print heads 50*a* and 50*b* are capable of printing each scan line moving in one direction and then print another scan line moving in the opposite direction. Each scan line pass begins by moving print heads 50*a* and 50*b* to the furthest left most or right most position within carriage 55, depending on the last print position of the print head, and accelerating the print heads by ramping up carriage motor 27 while in the non-printing area and prior to entering the printing area to the appropriate printing speed for printing the next scan line. In this fashion, the entire scan line will be printed at the same printing speed thereby reducing any contrast in print quality due to a varied speed of the carriage motor in the printing area. For example, as shown in FIG. 6*a*, print heads 50*a* and 50*b* begin their movement across the print area 80, which accommodates both A3 and A4 paper as well as standard sized paper, along carriage 55 either at the left most or right most position of printer 10. Because print heads 50*a* and 50*b* begin their movement beyond printing area 80, it is possible for carriage motor 27 to ramp-up or accelerate while in the non-printing area to a constant printing speed while in printing area 80, which results in proper print quality.

Figure 6B:
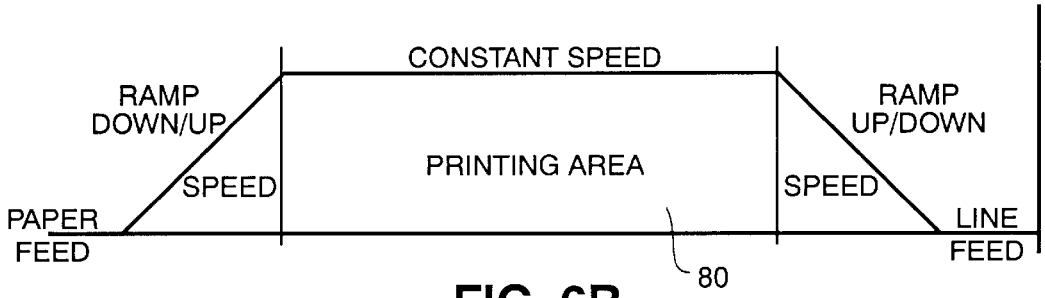
FIG. 6B is a diagram illustrating the ramp-up/ramp-down and constant speed areas of the carriage motor used in the present invention.

It is also during this ramp-up time which is approximately 70 msec, as shown in FIG. 6B, that print heads 50*a* and 50*b* accelerate to reach a constant speed once it enters printing area 80. In the case of bi-directional printing, as the print heads reach, for example, the left-most side after printing one scan line, carriage motor 27 begins to ramp-down or decelerate as line feed motor 29 advances the paper to the next scan position. After coming to a quick halt, carriage motor 27 accelerates print heads 50*a* and 50*b* back in the opposite direction by ramping speed back up in the opposite direction so that when it reaches printing area 80 it will be at a proper constant printing speed.

The greatest time delays suffered by conventional ink jet printers occur when attempting to print immediately after power-on and when a previous print job has occurred. The present invention avoids these delays by preheating during paper feed and again during the ramp-up/ramp-down periods.

Figure 6C:
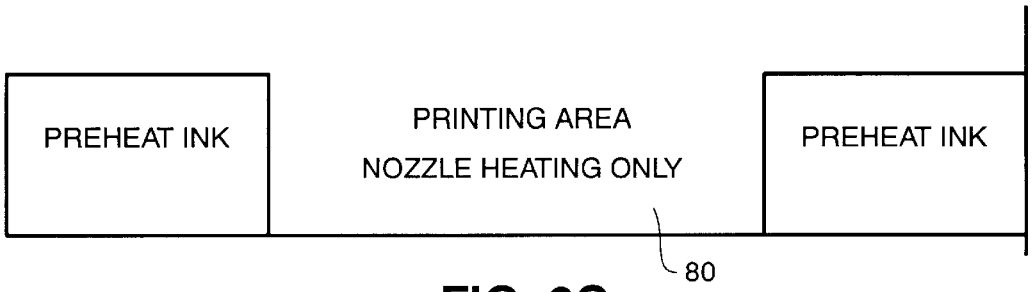
FIG. 6C is an illustrative diagram showing the timing of when preheating is performed during non-printing periods according to the present invention.

FIG. 6C shows that printer 10 enters a preheating period during paper feeding. That is, when CPU 35 receives a print command from host computer 3 via interface 30, CPU 35 will energize preheating elements 60. While the paper is being fed into printer 10, preheating elements 60 are energized and begin to heat the ink in liquid passageways 76, 77, 78 and 79, in preparation of printing an initial scan line.

In the present invention, preheating elements 60 can preheat the ink in liquid passageways 76, 77, 78 and 79 by 1°–2° C. in about 70 msec. This is approximately the amount of time required to ramp-up/ramp-down the carriage speed of carriage motor 27 to the appropriate printing speed before printing a scan line within printing area 80.

Because ramp-up or ramp-down periods take approximately 70 msec, it is only possible to preheat the ink by 1° C. to 2° C. using preheating elements 60 during these periods, which is not enough to raise the ink temperature from ambient temperature to approximately 60° C. Therefore, preheating is performed also during the paper feeding period which permits preheating elements 60 to preheat the ink from ambient temperature to the preheating temperature of about 60° C. Preheating during the ramp-up and ramp-down periods also permits fine tuning of the ink temperature. As a result of preheating both during paper feeding and ramp-up/ramp-down, print quality and density are well controlled especially during bi-directional printing.

Thus, during both paper feeding and ramp-up/ramp-down periods, CPU 35 detects the ambient temperature in printer 10 and determines whether it is appropriate to preheat the ink by energizing preheating elements 60 on heater board 70. As shown in FIG. 6C, printer 10 enters a preheating period both during the paper feeding period and the ramp-up/ramp-down of carriage motor 27. However, if the detected ambient temperature is equal to or above the predetermined temperature threshold of 50° C., preheating of the ink supplied to print head 50*a* and 50*b* is unnecessary. As a result, preheating elements 60 will not be energized. Once the detected ambient temperature drops below the predetermined temperature threshold, preheating during the next ramp-up/ramp-down will begin again. Upon entering printing area 80, preheating elements 60 are de-energized and heating elements 71, 72, 73 and 74 are energized to provide heat at each nozzle for printing.

Figure 7:
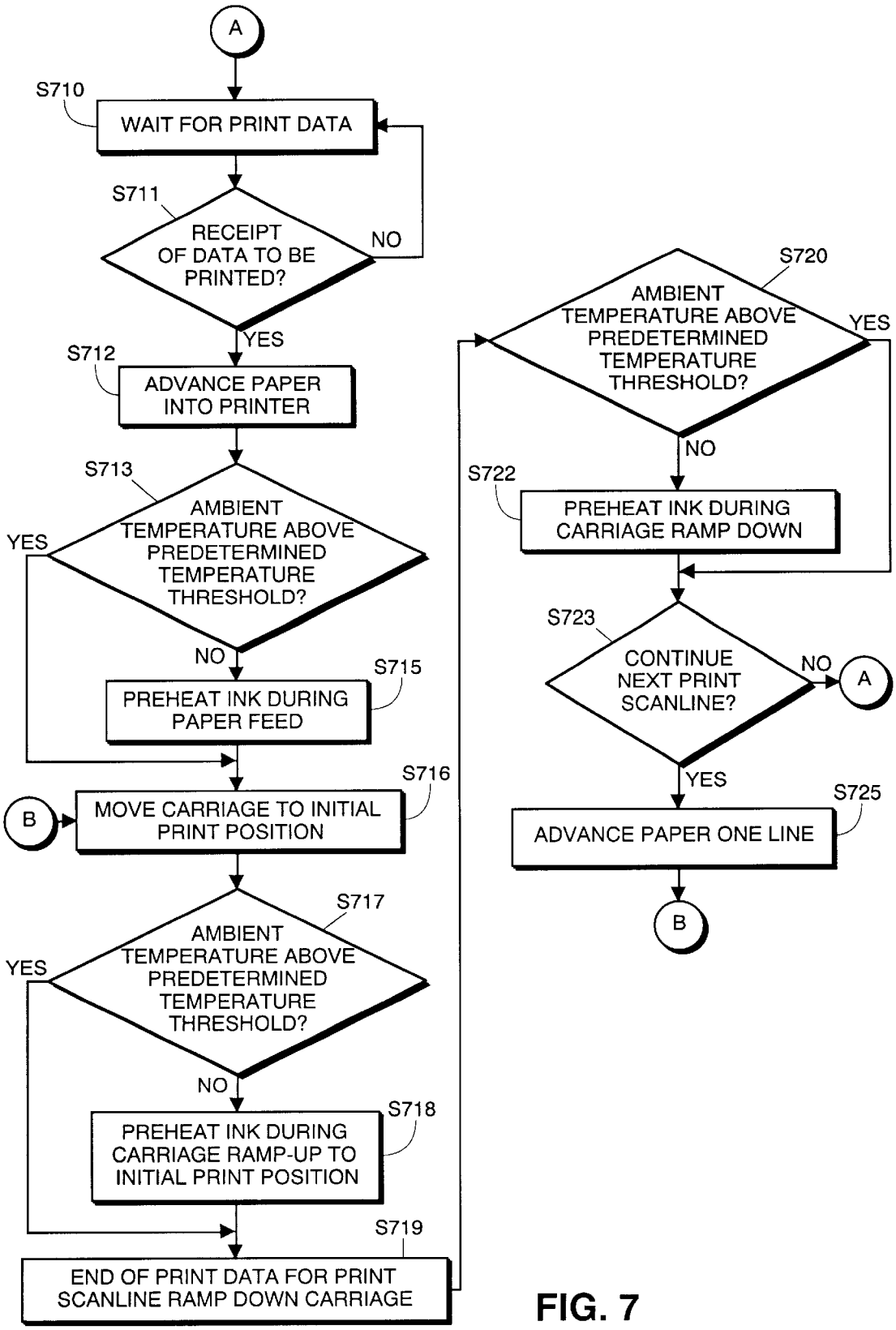
FIG. 7 is a flow chart showing the method of preheating ink during non-printing periods according to the present invention.

FIG. 7 is a flow diagram detailing the preheating of ink during the carriage ramp-up/ramp-down period and during the paper feeding period. Thus, in step S710, printer 10 enters a wait state and awaits print commands and data from host processor 3. During this wait period, CPU 35, at predetermined intervals, in step S711, checks for received print command and data. If no such command and data is received, CPU 35 reenters the wait state in step S710 and waits for print data. On the other hand, if a print command has been received, a sheet of paper is advanced into printer 10 in step S712. While the paper is being fed into printer 10, in step S713, CPU 35 requests the ambient temperature from thermistor 40.

Upon receiving the detected ambient temperature, CPU 35 determines if it is equal to or above 50° C. In the case that the ambient temperature is below the predetermined threshold, CPU 35 energizes preheating elements 60 on heater board 70 so as to preheat the ink in liquid passageways 76, 77, 78 and 79 as shown in FIG. 5. On the other hand, if the ambient temperature is equal to or above the predetermined temperature threshold, flow proceeds to step S716 and carriage motor 27 moves print heads 50*a* and 50*b* to the initial print position.

Prior to the carriage motor 27 ramping up to reach a constant speed for the initial print position, in step S717, ambient temperature is again checked to determine if it is equal to or above the predetermined threshold. If it is not equal to or above the predetermined threshold in step S718, printer 10 energizes the preheating elements 60 until the carriage enters the printing area 80 at which point only heating elements 71, 72, 73 and 74 are used to perform thin film boiling of the ink.

When the input of print data for one print scan line has ended, the constant speed of carriage 55 is ramped down upon entering the non-printing area. Also during this period in step S720, ambient temperature is checked to determine if it is equal to or above 50° C. If the temperature is below 50° C., in step S722, CPU 35 energizes preheating elements 60 so as to heat the ink in liquid passageways 76, 77, 78 and 79 in heater board 70. On the other hand, if the ambient temperature is above 50° C., flow proceeds to step S723.

In step S723, CPU 35 determines if there is another scan line to be printed. If yes, in step S725, the paper is advanced by one line and flow returns to step S716. In step S716, to begin the next scan line, carriage motor 27 moves print heads 50*a* and 50*b* to the beginning of the next scan line. on the other hand, if no additional printing is to be performed, flow proceeds to step S710 in which printer 10 enters a wait state.

What is claimed is:

1. An ink ejecting method for an ink jet printer comprising the steps of:

detecting an ambient temperature within the ink jet printer; and preheating ink supplied to a print head within the ink jet printer during at least one of an acceleration and a deceleration period of the print head based on the detected temperature.

2. A method according to claim 1, further comprising the step of determining if the detected temperature is below a threshold temperature wherein, in a case where said determining step determines that the detected temperature is below the threshold temperature, the ink supplied to the print head is preheated, and wherein in the case where said determining step determines that the detected temperature is equal to or above the threshold temperature, the ink supplied to the print head is not preheated.

3. The method according to claim 2, further including the steps of:

receiving print data to be printed by the print head;

feeding paper into the ink jet printer in response to the receipt of print data; and moving a printer carriage which carries the print head from a non-printing area into a printing area in the ink jet printer during a printing operation of the print data.

4. The method according to claim 3, wherein, after print data is received and paper is fed into the ink jet printer, the detecting step detects the temperature in the ink jet printer and the determining step determines if the detected temperature is below the threshold temperature.

5. The method according to claim 4, wherein in the case where said determining step determines that the detected temperature is below the threshold temperature, simultaneously performing the steps of preheating and moving the printer carriage from the non-printing area to the printing area.

6. The method according to claim 5, wherein when the printer carriage enters the printing area, stopping the preheating of the ink supplied to the print head.

7. The method according to claim 3, wherein the step of preheating is performed during the feeding step.

8. The method according to claim 3, wherein the step of preheating is performed during both the step of feeding and the step of moving the printer carriage in the non-printing area.

9. The method according to claim 8, wherein, in the moving step a speed of the printer carriage is ramped-up to a predetermined speed in the non-printing area for printing in the printing area and is ramped-down to a predetermined speed after exiting the printing area into the non-printing area.

10. The method according to claim 9, wherein the preheating step is performed during ramp-up and ramp-down of the printer carriage speed in the non-printing areas and during the feed step.

11. The method according to claim 1, wherein the threshold temperature is 50° C.

12. A method according to claim 1, wherein the step of preheating is performed by a preheating element which is independent of a heating element used to eject ink from the print head.

13. A method for preheating ink in an ink jet printer comprising the steps of:

a) receiving print data and commands;

b) feeding paper into the ink jet printer in response to the receipt of print data and commands;

c) detecting an ambient temperature within the ink jet printer and determining if the ambient temperature is below a threshold temperature;

d) preheating ink supplied to a print head in the ink jet printer during the feeding step in a case where the detected ambient temperature is below the threshold temperature;

e) moving a printer carriage carrying the print head from a non-printing area to a printing area;

f) repeating the detecting step;

g) preheating ink supplied to the print head during the moving of the printer carriage in the non-printing area in a case where the detected ambient temperature is below the threshold temperature; and h) printing the received print data based on the received commands.

14. The method according to claim 13, wherein, in the moving step, a speed of the printer carriage is ramped-up to a predetermined speed in the non-printing area for printing in the printing area and is ramped-down to a predetermined speed after exiting the printing area into another non-printing area.

15. The method according to claim 14, wherein the preheating step is performed during ramp-up and ramp-down of the printer carriage speed in the non-printing areas and during the feed step.

16. A method according to claim 13, wherein the threshold temperature is 50° C.

17. An ink ejecting apparatus for an ink jet printer, comprising:

detecting means for detecting an ambient temperature within the ink jet printer; and preheating means for preheating ink supplied to a print head within the ink jet printer during at least one of an acceleration and a deceleration period of the print head based on the detected temperature.

18. An apparatus according to claim 17, further comprising a determining means for determining if the detected temperature is below a threshold temperature, wherein in a case where said determining means determines that the detected temperature is below the threshold temperature, the ink supplied to the print head is preheated, and wherein in a case where said determining means determines that the detected temperature is equal to or above the threshold temperature, the ink supplied to the print head is not preheated.

19. The apparatus according to claim 17, further comprising:

receiving means for receiving print data to be printed by the print head;

feeding means for feeding paper into the ink jet printer in response to the receipt of print data; and moving means for moving a printer carriage which carries the print head from a non-printing area into a printing area in the ink jet printer during a printing operation of the print data.

20. The apparatus according to claim 19, wherein, after print data is received and paper is fed into the ink jet printer, the detecting means detects the temperature in the ink jet printer and the determining means determines if the detected temperature is above the threshold temperature.

21. The apparatus according to claim 20, wherein in a case where said determining means determines that the detected temperature is below the threshold temperature, the preheating means simultaneously preheats the ink while the moving means moves the printer carriage from the non-printing area to the printing area.

22. The apparatus according to claim 21, wherein when the printer carriage enters the printing area, the preheating means stops preheating the ink supplied to the print head.

23. The apparatus according to claim 19, wherein the preheating means preheats during the feeding of paper.

24. The apparatus according to claim 19, wherein the preheating means preheats during both the feeding of paper by the feeding means and when the moving means moves the printer carriage while in the non-printing area.

25. The apparatus according to claim 24, wherein the moving means ramps-up the printer carriage to a predetermined speed in the non-printing area for printing in the printing area and ramps-down the printer carriage to a predetermined speed after exiting the printing area into another non-printing area.

26. The apparatus according to claim 25, wherein the preheating means preheats during ramp-up and ramp-down of the printer carriage speed in the non-printing areas and when the feeding means feeds paper into the ink jet printer.

27. An apparatus for preheating ink in an ink jet printer comprising:

receiving means for receiving print data and commands;

feeding means for feeding paper into the ink jet printer in response to the receipt of print data and commands;

detecting means for detecting an ambient temperature within the ink jet printer and determining if the ambient temperature is above a threshold temperature;

preheating means for preheating the ink supplied to a print head in the ink jet printer during feeding of paper by the feeding means in the case the detected ambient temperature is below the threshold temperature;

moving means for moving a printer carriage carrying the print head from a non-printing area to a printing area, wherein during the moving of the carriage from a non-printing area to a printing area, the detecting means detects the ambient temperature again and determines if the ambient temperature is below the threshold temperature and, in a case that the ambient temperature is below the threshold, the preheating means preheats the ink supplied to the print head during the moving of the printer carriage in the non-printing area.

28. The apparatus according to claim 27, further comprising control means for controlling the print head to print the received print data based on the received commands.

29. The apparatus according to claim 27, wherein the moving means controls a speed of the printer carriage so as to ramp-up to a predetermined speed in the non-printing area prior to printing in the printing area and ramps-down the printer carriage to a predetermined speed after exiting the printing area into another non-printing area.

30. The apparatus according to claim 27, wherein the preheating means preheats during ramp-up and ramp-down of the printer carriage speed in the non-printing areas and during the feeding of the paper by the feeding means.

31. A memory medium storing computer-executable process steps, the process steps comprising:

a detecting step for detecting an ambient temperature within the ink jet printer; and a preheating step for preheating ink supplied to a print head within the ink jet printer during at least one of an acceleration and a deceleration period of the print head based on the detected temperature.

32. A memory medium storing computer-executable process steps according to claim 31, further comprising the step of determining if the detected temperature is below a threshold temperature, wherein in a case where said determining step determines that the detected temperature is below the threshold temperature, the ink supplied to the print head is preheated, and in a case where said determining step determines that the detected temperature is equal to or above the threshold temperature, the ink supplied to the print head is not preheated.

33. A memory medium storing computer-executable process steps for preheating ink supplied to a print head, the process steps comprising:

a) a receiving step for receiving print data and commands;

b) a feeding step for feeding paper into the ink jet printer in response to the receipt of print data and commands;

c) a detecting step for detecting an ambient temperature within the ink jet printer and determining if the ambient temperature is below a threshold temperature;

d) a preheating step for preheating the ink supplied to a print head in the ink jet printer during the feeding step in a case where the detecting step determines that the detected ambient temperature is below the threshold temperature;

e) a moving step for moving a printer carriage carrying the print head from a non-printing area to a printing area;

f) a repeating step for repeating the detecting step;

g) a preheating step for preheating ink supplied to the print head during the moving of the printer carriage in the non-printing area in a case where the detecting step determines the detected ambient temperature is below the threshold temperature; and h) a printing step for printing the received print data based on the received commands.

34. An ink ejecting method for an ink jet printer comprising the steps of:

detecting a temperature within the ink jet printer;

determining if the detected temperature is below a threshold temperature; and preheating ink supplied to a print head within the ink jet printer during moving of a carriage including the print head in non-printing periods, wherein, in a case where said determining step determines that the detected temperature is below the threshold temperature, the ink supplied to the print head is preheated to reduce image density unevenness during printing periods, and in a case where said determining step determines that the detected temperature is equal to or above the threshold temperature, the ink supplied to the print head is not preheated.

35. An ink ejecting apparatus for an ink jet printer comprising:

detecting means for detecting a temperature within the ink jet printer;

determining means for determining if the detected temperature is below a threshold temperature; and preheating means for preheating ink supplied to a print head within the ink jet printer during moving of a carriage including the print head in non-printing periods, wherein, in a case where said determining means determines that the detected temperature is below the threshold temperature, the ink supplied to the print head is preheated to reduce image density unevenness during printing periods, and in a case where said determining means determines that the detected temperature is above the threshold temperature, the ink supplied to the print head is not preheated.

36. A memory medium storing computer-executable process steps, the process steps comprising:

a detecting step for detecting a temperature within the ink jet printer;

a determining step for determining if the detected temperature is below a threshold temperature; and a preheating step for preheating ink supplied to a print head within the ink jet printer during moving of a carriage including the print head in non-printing periods, wherein, in a case where said determining step determines that the detected temperature is below the threshold temperature, the ink supplied to the print head is preheated to reduce image density unevenness during printing periods, and in a case where said determining step determines that the detected temperature is above the threshold temperature, the ink supplied to the print head is not preheated.

37. An ink ejecting method for an ink jet printer comprising the steps of:

detecting a temperature within the ink jet printer;

determining if the detected temperature is below a threshold temperature; and preheating ink supplied to a print head within the ink jet printer during moving of a carriage including the print head in non-printing periods, wherein, in a case where said determining step determines that the detected temperature is below the threshold temperature, the ink supplied to the print head is preheated during bi-directional printing modes to reduce image density unevenness, and in a case where said determining step determines that the detected temperature is equal to or above the threshold temperature, the ink supplied to the print head is not preheated.

38. An ink ejecting apparatus for an ink jet printer comprising:

detecting means for detecting a temperature within the ink jet printer;

determining means for determining if the detected temperature is below a threshold temperature; and preheating means for preheating ink supplied to a print head within the ink jet printer during moving of a carriage including the print head in non-printing periods, wherein, in a case where said determining means determines a that the detected temperature is below the threshold temperature, the ink supplied to the print head is preheated during bi-directional modes to reduce image density unevenness, and in a case where said determining means determines that the detected temperature is above the threshold temperature, the ink supplied to the print head is not preheated.

39. A memory medium storing computer-executable process steps, the process steps comprising:

a detecting step for detecting a temperature within the ink jet printer;

a determining step for determining if the detected temperature is below a threshold temperature; and a preheating step for preheating ink supplied to a print head within the ink jet printer during moving of a carriage including the print head in non-printing periods, wherein, in a case where said determining step determines that the detected temperature is below the threshold temperature, the ink supplied to the print head is preheated during bi-directional printing modes to reduce image density unevenness, and in a case where said determining step determines that the detected temperature is above the threshold temperature, the ink supplied to the print head is not preheated.

* * * * *

UNITED STATES PATENT AND TRADEMARK OFFICE

CERTIFICATE OF CORRECTION

PATENT NO. : 6,260,940 B1
DATED : July 17, 2001
INVENTOR(S) : Akitoshi Yamada et al.

It is certified that error appears in the above-identified patent and that said Letters Patent is hereby corrected as shown below:

Title page,
Item [56] References Cited, FOREIGN PATENT DOCUMENTS,
"5 169 644" should read -- 5-169644 --.

Column 14,
Line 2, "a" should be deleted.

Signed and Sealed this

Fourteenth Day of May, 2002

*Attest:*

*Attesting Officer*

JAMES E. ROGAN
*Director of the United States Patent and Trademark Office*